United States Patent [19]

Filges et al.

[11] Patent Number: 4,995,809

[45] Date of Patent: Feb. 26, 1991

[54] BAFFLES FOR TUBE COOLERS, ROTARY TUBULAR KILNS OR THE LIKE

[75] Inventors: Ralf Filges, Bergisch Gladbach; Fred Klotmann; Hans J. Wutschke, both of Cologne, all of Fed. Rep. of Germany

[73] Assignee: Kloeckner-Humboldt-Deutz Aktiengesellschaft, Fed. Rep. of Germany

[21] Appl. No.: 427,505

[22] Filed: Oct. 27, 1989

[30] Foreign Application Priority Data

Nov. 5, 1988 [DE] Fed. Rep. of Germany ..... 3837607

[51] Int. Cl.[5] ..... F27B 7/14

[52] U.S. Cl. ..... 432/118; 432/105; 34/136

[58] Field of Search ..... 34/136, 134, 137, 139, 34/179, 172, 135; 366/57, 229, 24; 432/118, 103, 78, 105, 110

[56] References Cited

U.S. PATENT DOCUMENTS 4,338,732 7/1982 Coxhill ..... 34/136 X

*Primary Examiner*—Henry A. Bennett

*Attorney, Agent, or Firm*—Hill, Van Santen, Steadman & Simpson

[57] ABSTRACT

A rotary drum for tumbling a granular product therein for heat transfer or drying with arcuate baffles mounted on the inner surface of the drum with the concave surface of the baffles facing outwardly and the baffles having rims at the ends to restrict discharge of material from the baffles and the baffles being offset circumferentially in a trailing downstream direction with openings through the baffles and an angled downstream edge of certain baffles with other baffles having a portion of the downstream edge removed and the baffles formed in two sections hinged to each other with the ends secured to the inner surface of the drum.

19 Claims, 2 Drawing Sheets

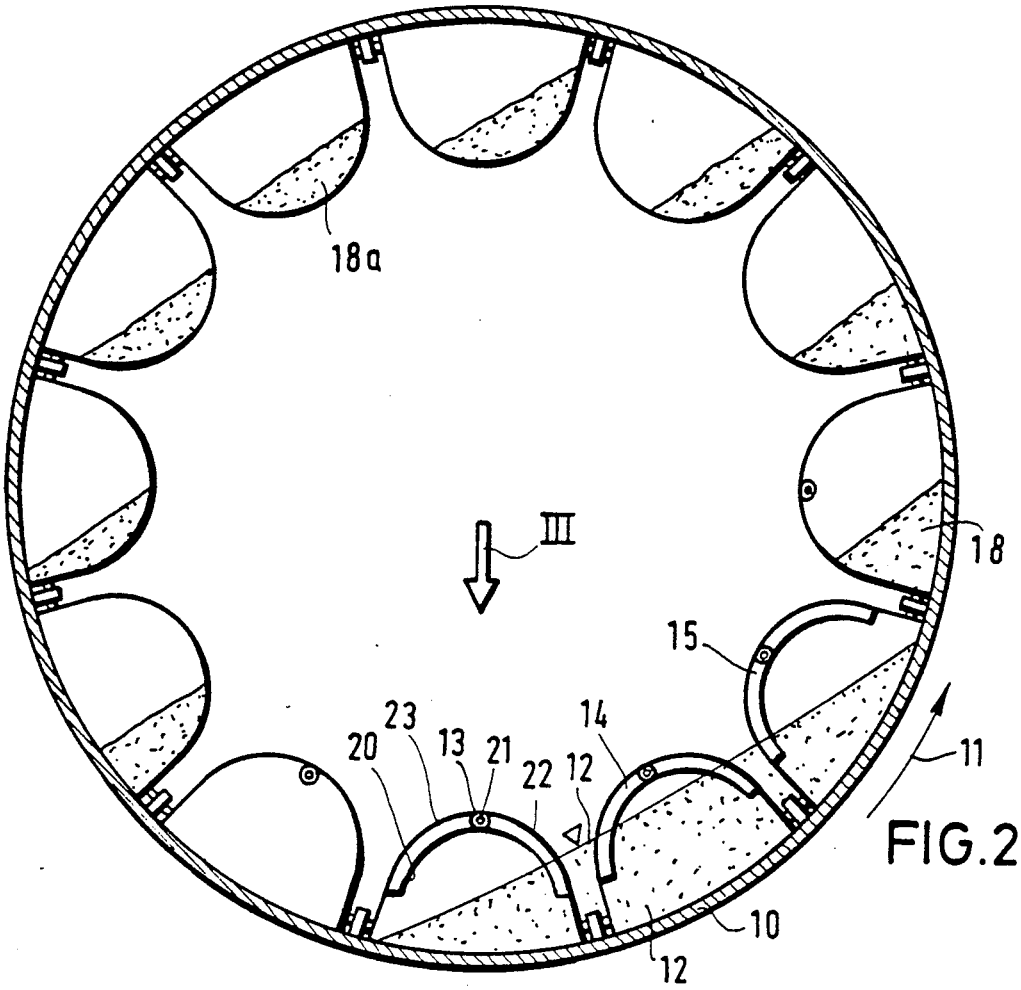
FIG.2
FIG.3
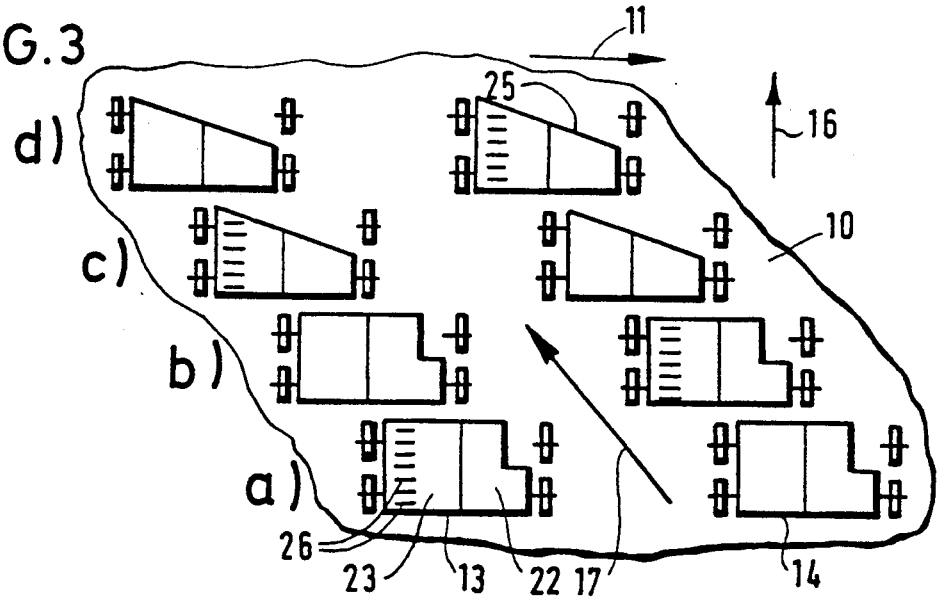

BAFFLES FOR TUBE COOLERS, ROTARY TUBULAR KILNS OR THE LIKE

BACKGROUND OF THE INVENTION

The invention relates to improvements in rotary exchange equipment wherein particulate material is carried in a rotary drum and subjected to a drying or cooling process, and more particularly to an improved structure wherein the treatment of particulate material is enhanced.

The function of a cooler, for example of a tube cooler or of a satellite cooler, is to cool a hot product such as cement clinker coming from a kiln to the farthest possible degree. Also the function is simultaneously heat the cooling air flowing through the cooler to the farthest possible degree before it usually enters into the kiln. Such air is referred to as secondary air and is employed there as combustion air. The degree of cooling depends on the heat transmission between the product and the cooling or secondary air. The quantity of product, the quantity of air, the product temperature and the air temperature, each upon entry into the cooler, as well as the product qualities such as the granulation, cannot be influenced by the cooler. The cooler efficiency is essentially defined by three conditions, the size of the heat transmission surfaces, the dwell time of the product in the cooler, and dust formation and dust circulations.

It is known to enhance the efficiency of a tube cooler or of a satellite cooler by integrating lifter shovels or lifter ledges composed of wear-resistant steel. These lift the hot cement clinker and drop it into the stream of cooling air and an intimate contact of the cooling air with the clinker being thereby achieved. Such baffles that scatter the hot product have previously been utilized only in the central region of the cooling tube as well as the end region of the cooling tube at the product discharge side. Such baffles cannot be employed in the hot zone of the cooler adjoining the kiln because a scattering of the product material by the cooling airstream must be absolutely avoided in this hot zone. In this zone the temperature difference between hot material and cooling air is also greatest because the cooling air would otherwise be loaded with dust which diminishes the heat transmission in the hot cooler zone and undesirably transports the cooling air/secondary air back into the sintering kiln. This leads to a deterioration of the efficiency of the overall process.

It is likewise known to improve the heat transmission using what are referred to as cross baffles. These baffles are preferably utilized for superfine material that is to be scattered as little as possible. The utilization of such cross baffles in the hot zone of a cooler would lead to mechanical problems and would be disadvantageous for the distribution of the product onto the cross-section. Only mushroom-shaped or cone-shaped baffles have been utilized in the hot zone of the cooling tube and these essentially having the job of blending the nodule of product material lying in the cooling tube without a lifting effect in order to achieve a better heat transmission by radiation by creating new product surfaces. The large surface of product material required for a good heat transmission, however, is not achieved in this way, so that the heat transmission especially in this hot zone of the cooler is still in need of improvement.

An object of the present invention is to increase the thermal efficiency of a rotary cooler, particularly in the critical hot zone without having the accept a noticeable increase in the dust load on the gas stream or an increase in the dimensions of the rotary cooler.

A further object of the invention is to improve the thermal efficiency in the rotary drum for the treatment of a granular or partly scatterable material in the tube cooler, satellite cooler, rotary tubular kiln, drum dryer or the like.

FEATURES OF THE INVENTION

Baffles are secured to the inside wall of the rotary tube and are comprised of arcuate elements projecting approximately semicircularly, arch-like into the inside of the tube as seen in the tube cross-section, these arcuate elements having a rim edge at each of their two ends directed toward the inside wall of the tube. These rims constrict the free cross-sectional area of the arcuate and prevents the scattering of the product material lifted in the arcuate elements. The rotary tube baffles are installed particularly in the hot zone of the rotary tube and exhibit the following advantages.

Due to the division of the overall product material lying in the rotary tube into many individual groups, material whose plurality corresponds to the plurality of arcuate elements integrated in the rotary tube, the heat-radiating surface of the material is enlarged and the heat transmission is considerably improved as a result thereof. Each arcuate element is fashioned such that the quantity of product material entering at the end face can first freely move toward both sides and the quantity of product material subsequently situated in the arcuate element remains in the arcuate over about half a revolution of the rotary tube.

A feature of the invention is that a random scattering of the product material is thereby effectively prevented in that the arcuate elements have a respective rim edge at both end. These rim edges extend toward the inner surface of the rotary tube and constrict the free cross-sectional area of the arch. The rim edges at both ends of each arcuate element prevent the scattering of the product material which would be particularly undesirable in the hot zone. In order to improve the product damming effect due to the inclination of the rotary tube, the rim edge of every arcuate element facing toward the product discharge of the rotary tube is preferably higher in its rim height than the other rim edge facing toward the product admission end of the rotary tube.

After reaching the opposite side of the rotary tube following half a revolution of the rotary tube, the product material from the arcuate element runs out onto the material-free tube wall without being scattered, this in turn leading to an enlarged surface of product material as well as to an improved heat transmission. At the same time, the product material is circulated in the arcuate elements during about half a revolution of the rotary tube and this can promoted by ledge ribs that are arranged proceeding roughly parallel to the axis of the rotary tube at least in the apex region of the arcuate elements in order to create constantly new surface of the product material.

Other objects, advantages and features of the invention will become more apparent with the teaching of the principles thereof in connection with the disclosure of the preferred embodiment in the specification, claims and drawings, in which:

DESCRIPTION OF THE DRAWINGS

FIG. 2 is a vertical sectional view taken through the axis of a rotary tube or drum constructed in accordance with the invention; and FIG. 3 is a fragmentary plan view taken in the direction indicated by the arrowed line III in FIG. 2

DESCRIPTION OF THE PREFERRED EMBODIMENT

Figure 1:
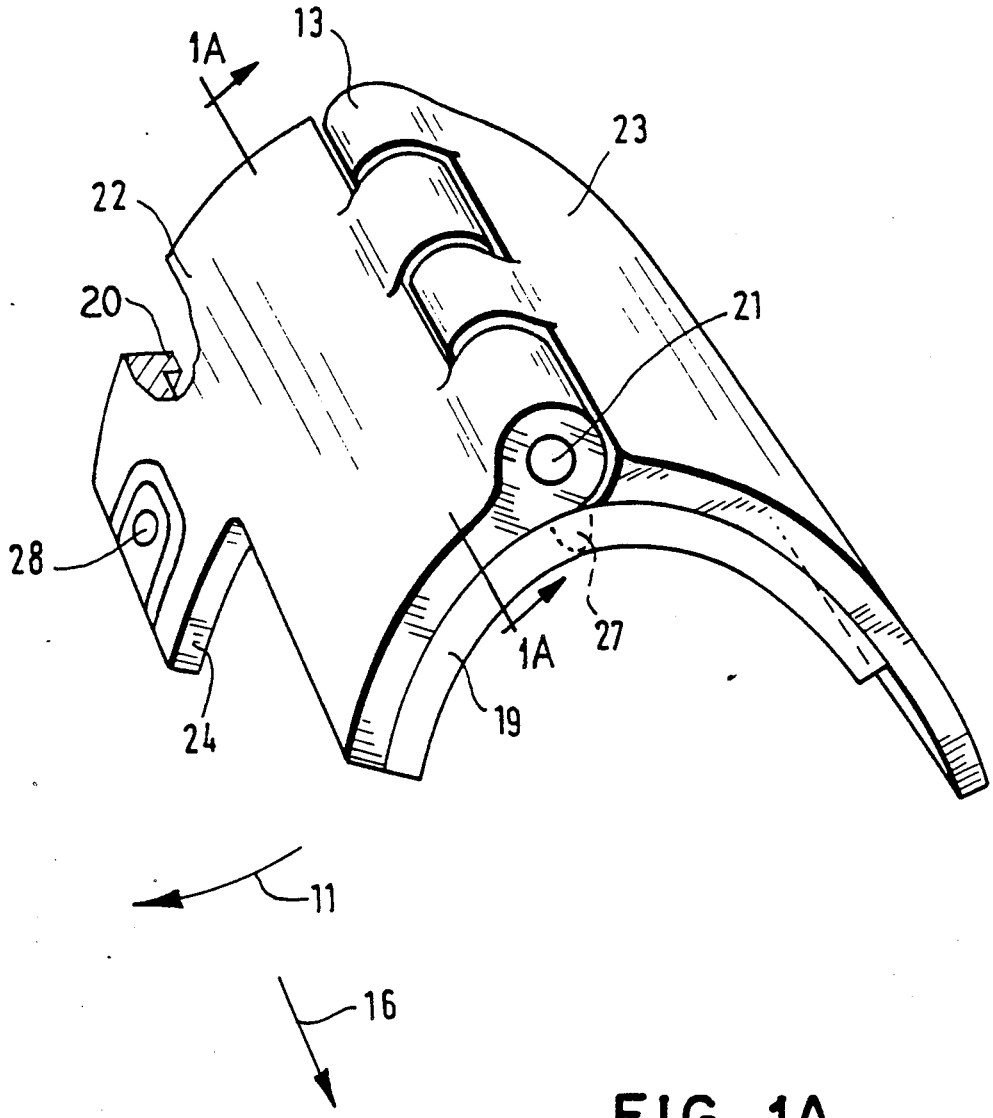
FIG. 1 is a persepctive view of an arcuate element embodying the principles of the present invention and which is secured to the inner surface of a rotary drum or tube.

FIG. 2 shows cross-section through a rotary drum or tube cooler 10 that rotates around its axis in arrowed direction 11. For example, hot cement clinker that comes from a cement clinker kiln preceding the cooler is cooled in the cooler 10 and the cooling air flowing in counter-current flow relative to the product material is simultaneously heated before this cooling air enters into the kiln. This is referred to as secondary air.

The view in FIG. 2 is directed in the main flow direction of the hot product material. This hot product material lies in the lower region of the cooling tube 10 on the inside wall thereof and may be referred to as a nodule or group 12 of product material having a slanting surface.

In accord with the invention, the tube cooler 10 comprises baffles that are comprised of arcuate elements 13, 14, and 15, uniformly distributed over the inside wall of the tube, and are detachably and interchangeably secured thereto.

In the plan view of FIG. 3 in which the arrow 11 indicates the rotational sense of the tube cooler 10 and the arrow 16 indicates the main flow direction of the hot product material, the arcuate elements 13 and 14, for example, of FIG. 2 may be seen in plan view. It may also be seen in FIG. 2 that the arcuate elements are arranged in a circle and belong to neighboring circles a, b, c, d are respectively offset relative to one another at their end faces, FIG. 3. Product transport lanes 17 proceed at a slant relative to the cylinder generated lines of the rotary tube 10 are formed between the arcuate elements neighboring one another as seen in rotary tube direction 11.

Individually enlarged in a perspective view, FIG. 1 and sectional view 1A show arcuate elements with the axial flow direction of the product material to be cooled shown by arrow 16. The rotational sense of the rotary tube here is indicated by the arrow 11. The arcuate elements secured to the inside wall of the rotary tube 10 have a rim edge at each of their ends. This rim edge constricts the free cross-sectional surface of the arch and prevents the lifted product 18 situated in the arcuate elements from being scattered out. For example, the arcuate element 13 has the rim edge 19 at its end face facing toward the product discharge of the rotary tube 10 which may be seen in FIG. 1 and the rim edge 20 facing toward the product admission of the rotary tube. The rim edge 19 facing toward the product discharge of the rotary tube at every arcuate element can advantageously have its rim height higher than the respectively other rim edge 20 in order to achieve an adequate damming effect for the quantity of product material respectively lifted in the arcuate element despite the slope of the rotary tube in the flowing direction 16 of the material.

The arcuate elements 13 are comprised of two parts that are detachably joined to one another in the region of their apex arc, for example by a simple hook-in connection, bolted connection or some other hinged connection 21. The arcuate elements are advantageously respectively composed of two halves whereas the front or leading half 22 as seen in the rotational sense 11 of the rotary tube 10 is narrower from end face to end face than the other trailing half 23. The narrow half 22 of each arcuate element has a stepped setoff 24 at its leading edge, FIG. 1. facing axially toward the product entry end of the rotary tube. This facilitates the run-out of lifted product material from the individual arcuate elements in the region of the rotary tube 10 lying opposite the nodule 12 of product material.

When, for example, the arcuate element is fashioned of three parts, then the middle part that is most highly or has the greatest wear can be advantageously interchanged.

So that the superfine material is initially not lifted at all by the arcuate elements, the broad half 23 (the back half as seen in the rotational sense 11 of the rotary tube) of some or even of all arcuate elements can comprise through passages 26 such as, for example, slots for the passage of the superfine material.

Figure 1A:
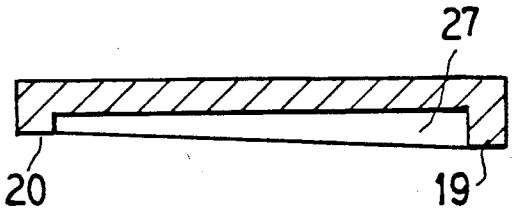
FIG. 1A is a detailed cross-sectional view taken substantially along line IA-IA of FIG. 1.

Ledges or ribs 27 that circulate or tumble the product material situated in the arcuate element extend roughly parallel to the axis of the rotary tube can be arranged at least in the apex region of the arcuate elements. The ledge 27 is shown in FIG. 1 and in solid lines in FIG. 1A. These ledges can also have a conveying or damming effect for the product, for example when emptying the respective arcuate element.

Every arcuate element 13, 14 and 15 is fashioned such that the quantity of product material, for example 18, that has entered can initially freely move toward both sides and the quantity 18*a* of material subsequently situated in the arcuate element remains in the arcuate element over about half a revolution of the cooler. A scattering of product material is thereby efficiently prevented by the rims 19, 20 at each of the two respective ends, and the rim 19 at the product discharge end is a higher rim because of the slope of the cooling tube. After reaching the opposite side of the rotary tube after about half a revolution of the rotary tube, the product material can run out of what is here the narrow half 22 of every arcuate element. Without being scattered into the stream of cooling air, the product material proceeds in this fashion onto the material-free inside wall of the rotary tube 10 lying opposite the nodule 12 of product material. This in turn leads to an enlarged surface of material and thus to improved heat transmission. During the approximately a half revolution of the cooling tube 10, the product material situated in the arcuate elements is simultaneously turned over by the ledges 27 in order to create new heat-radiating surfaces.

The arcuate elements are comprised of two halves 22 and 23, for example cast of heat-resistant cast steel. Assembly is facilitated and thermal expansions are governed. The fastening of the arcuate elements in the rotary tube expediently occurs at wear-protected retaining members welded into the jacket of the rotary tube, namely at two points at the broad half 23 and at one point 28 at the narrow arcuate half 22, so that a three-point fastening respectively derives for the entire arcuate 13. The arcuate elements themselves as well as their anti-wear protection can be composed of steel, castings, ceramic or similar wear-resistant material.

Only one basic baffle shape, namely the arcuate element shape, has to be used for all zones of the tube cooler. Dependent on the desired function (non-scattering, scattering), different embodiments are selected. Taking the qualities of the material into consideration, of course, all baffles can be interchanged with one another and can be combined with one another. The halves of the arcuate elements can be individually interchanged and can also be individually replaced after wear. All fastenings both arcuate element halves to one another as well as to the inside wall of the tube are identically executed. At least in the hot zone of the tube cooler the arcuate elements and the wall parts of the tube can be provided with an additional wear protection. The number and depth of the arcuate elements is variable dependent on the requirements.

Moving from hot zone to the cold zone of the tube cooler 10, the integrated arcuate elements can be fashioned such that they do not scatter the product material in the hot zone but allow a gradually increasing scattering of material upon transition to the cold zone. For example, the rim edges at the end faces of the arcuate elements are fashioned lower and lower and/or a slanting arcuate chamfer 25 may be selected. The arcuate elements are secured with bolts or screws at the inside wall of the rotary tube, being secured at retaining members projecting therefrom. Through screws in the tube jacket are not necessary. Retaining members that do not carry any integrated arcuate elements have the function of turning ledges for the nodule 12 of product material. The arcuate elements can be cylindrically or spherically arched or can be comprised of planar surfaces.

The dwell time of the material in the rotary tube is essentially influenced by the density of the baffle arrangement, the height of the rim edges 19, 20 at the end faces of the arcuate elements, by the lanes 17 formed between the baffles, by the out-scattered direction toward the admission or discharge, and by the arrangement and plurality of conveying ledges.

The rotary tube baffles of the invention create the possibility of optimizing tube coolers, rotary tubular kilns or the like in a simple way. The ultimate properties of the product to be respectively treated such as, for example, density, porosity, thermal conductivity, grain distribution can be predicted to only a limited degree in advance. The inventive concept of rotary tube baffles allows the dwell time of the product material in the rotary tube, the dust formation and dust circulations and, thus, ultimately, the quality of the heat transmission between product material and gas to be beneficially influenced by the greatest possible variable arrangement, combination, replacement, etc. of the respectively integrated arcuate elements.

In operation, cooling air is directed into the rotary drum 10 from the downstream end which is from the top of FIG. 3. Material to be treated is loaded into the upstream or entry end to flow in the direction indicated by the arrowed line 17 in FIG. 3. As the drum 10 rotates, the granular material 12 is caught up within the arcuate baffles and is tumbled to flow around inside of the baffles as well as moving between the rows of baffles as shown in FIG. 3. As individual compartments or groups of material are carried upwardly with rotation of the drum in the direction of the arrowed line 11 in FIG. 2, the material tends to pass out of the discharge end of the baffles due to the fact that the axis of the drum 10 is sloped in a downward direction, so that the material therein moves while it is being cooled in the direction of the arrowed line 17 in FIG. 3. Very fine material passes out through the openings 26 in the baffles and the principal granular material being treated is continually tumbled and exposed to be carried upwardly by the rotating drum and dropped when it is at the top of the drum so that increased exposure to the cooling gas and to the outer surface of the baffles as well as the surface of the drum is encountered.

Thus, it will be seen there has been provided an improved structure for handling granular or pulverulent material which meets the objectives and advantages above set forth for an improved heat transfer process or drying process dependent upon the needs of the process. The structure is simple in construction and has interchangeable parts and accommodates servicing and replacement of worn parts.

We claim as our invention:

1. A mechanism for improved thermal energy transfer relative to a product within a rotary drum comprising in combination:

a rotary drum for a product subjected to tumbling therein for thermal energy transfer;

shaped baffles extending arcuately into the drum interior mounted on an inner surface of the drum with a concave surface facing outwardly of the drum interior and extending generally axially of the drum to carry the product tumbled within the drum;

said baffles defining a space limited inwardly by the arcuate baffles and outwardly by an interior surface of the drum, this space being permeated by gas within the drum and by lifted granular material product tumbled within the drum;

and surface constricting drum edges on the axial ends of the concave surface of the baffles constricting the inner area of the baffles preventing a product from being scattered axially from the baffles.

2. A mechanism for improved thermal energy transfer relative to a product within a rotary drum constructed in accordance with claim 1:

wherein the drum has an entry upstream end and a discharge downstream end and a rim edge at a downstream end of the baffle has a greater depth than the rim at the upstream end to restrict product discharge from the baffles.

3. A mechanism for improved thermal energy transfer relative to a product within a rotary drum constructed in accordance with claim 1:

wherein said rim edges are removably mounted on the surface of the baffle.

4. A mechanism for improved thermal energy transfer relative to a product within a rotary drum constructed in accordance with claim 1:

wherein the drum is driven in a tumbling processing rotational direction and has a product entry end and a product discharge end, and said baffles are of shorter length in the drum spaced axially along the drum length with sequential baffles from the entry end to the discharge end being offset circumferentially in a direction counter to the rotational direction of the drum.

5. A mechanism for improved thermal energy transfer relative to a product within a rotary drum constructed in accordance with claim 1:

wherein said baffles are constructed of two arcuate parts releasably joined to each other.

6. A mechanism for improved thermal energy transfer relative to a product within a rotary drum constructed in accordance with claim 1:

wherein the drum has a product entry end and a product discharge end and the baffles have a longer arcuate length facing the entry end of the drum than at the end facing the drum discharge end.

7. A mechanism for improved thermal energy transfer relative to a product within a rotary drum constructed in accordance with claim 1:

wherein the drum has an entry end and a discharge end and the baffles have a stepped removed portion at the discharge end.

8. A mechanism for improved thermal energy transfer relative to a product within a rotary drum constructed in accordance with claim 1:

wherein the baffles have discharge openings extending therethrough for the passage of superfine material being processed within the drum.

9. A mechanism for improved thermal energy transfer relative to a product within a rotary drum constructed in accordance with claim 1:

including axial ribs on the inner surface of the baffles extending in an axial direction and located generally midway between the ends of the baffles.

10. A mechanism for improved thermal energy transfer relative to a product within a rotary drum comprising in combination:

a rotary cylindrical drum for a pulverulent product to be tumbled in the drum and subjected to thermal energy transfer, said drum having a product entry end and a product discharge end;

a plurality of concave arcuate baffles extending axially within the drums and spaced circumferentially along an inner surface thereof, each of said baffles including arcuate halves hinged to each other with the ends of the halves secured to the inner surface of the drum, said baffles being shorter axially than the drum length;

said baffles staggered circumferentially to be circumferentially offset counter to a direction of rotation of the drum from the entry end to the discharge end;

said baffles having openings therethrough for the passage of fine portions of the product;

certain of said baffles having an angled edge facing the discharge end of the drum, certain of said baffles having portions removed at the downstream edge of the baffles;

and arcuate rims on the inner surface of the baffles to carry the product to be tumbled with the rim on the entry end of the baffle being shorter than the rim at the discharge end thereof.

11. A mechanism for improved thermal energy transfer relative to a product within a rotary drum comprising in combination:

a rotary drum for a granular product tumbled within the drum for thermal energy transfer;

a plurality of arcuately shaped baffles extending generally axially within the drum being shorter than the drum and having a concave surface facing an inner surface of the drum to carry the product to be tumbled from the ends of the baffles;

and a rim means within the baffles limiting free flow of the product from the baffle ends.

12. A mechanism for improved thermal energy transfer relative to a product within a rotary drum constructed in accordance with claim 11:

wherein said rim means are located at the baffle ends.

13. A mechanism for improved thermal energy transfer relative to a product within a rotary drum constructed in accordance with claim 11:

wherein said rim means are located at the baffle ends and a deeper rim means is located at a discharge end of the baffle than at an entry end.

14. A mechanism for improved thermal energy transfer relative to a product within a rotary drum constructed in accordance with claim 11:

wherein said baffles are offset circumferentially from each other in an axial direction.

15. A mechanism for improved thermal energy transfer relative to a product within a rotary drum constructed in accordance with claim 14:

wherein the drum is rotated in a processing direction and the baffles are offset circumferentially from an entry end of the drum to a discharge end in a direction counter to the direction of drum rotation.

16. A mechanism for improved thermal energy transfer relative to a product within a rotary drum constructed in accordance with claim 11:

wherein a portion of the area of the baffle is removed for discharge of material from the baffle.

17. A mechanism for improved thermal energy transfer relative to a product within a rotary drum constructed in accordance with claim 11:

wherein the discharge end of the baffle is at an angle to a circumferential plane of the drum.

18. A mechanism for improved thermal energy transfer relative to a product within a rotary drum constructed in accordance with claim 11:

wherein the baffles are attached at their ends to the interior surface of the drum.

19. A mechanism for improved thermal energy transfer relative to a product within a rotary drum constructed in accordance with claim 18:

wherein the baffles are constructed in two sections joined by a hinge intermediate the ends.

* * * * *